United States Patent [19]

Rigden et al.

[11] Patent Number: 4,506,194

[45] Date of Patent: Mar. 19, 1985

[54] CATHODOLUMINESCENT LIGHT SOURCES AND ELECTRIC LIGHTING ARRANGEMENTS INCLUDING SUCH SOURCES

[75] Inventors: Sydney A. R. Rigden, Hertfordshire; Ian J. H. Sweet, Middlesex, both of England

[73] Assignee: The General Electric Company p.l.c., England

[21] Appl. No.: 494,905

[22] Filed: May 16, 1983

[30] Foreign Application Priority Data

Aug. 19, 1982 [GB] United Kingdom ..... 8223872

[51] Int. Cl.[3] ..... H01J 63/06

[52] U.S. Cl. ..... 315/200 R; 313/331; 313/477 HC; 313/596; 315/352

[58] Field of Search ..... 315/200 R, 352; 313/331, 332, 596, 477 HC; 445/34

[56] References Cited

U.S. PATENT DOCUMENTS 2,748,309 5/1956 Hurx ..... 313/596
2,890,364 6/1959 Kolkman ..... 313/596
4,173,730 11/1979 Young et al. ..... 315/53
4,270,071 5/1981 Morton ..... 313/53
4,344,015 8/1982 Marschka ..... 313/477 HC

FOREIGN PATENT DOCUMENTS 2070849 9/1981 United Kingdom .
2072958 10/1981 United Kingdom .

*Primary Examiner*—Harold Dixon
*Attorney, Agent, or Firm*—Kirschstein, Kirschstein, Ottinger & Israel

[57] ABSTRACT

In a cathodoluminescent lamp of the type having an electrically conductive coating forms the anode on the interior surface of the bulb wall, a phosphor coating overlies the anode coating and an electron emissive cathode below a grid, the lead to the anode passes through a glass tube, additional to the exhaust tube, incorporated in the pinched foot tube, and is sealed through the pinch, and the contact between the anode lead and the anode coating on the bulb is provided by a bent metal strip attached to envelope the neck and partially covered by the anode coating, which extends partly down the neck, the end of the anode lead being engaged with an upstanding portion of the contact strip.

5 Claims, 3 Drawing Figures

Figure 1:
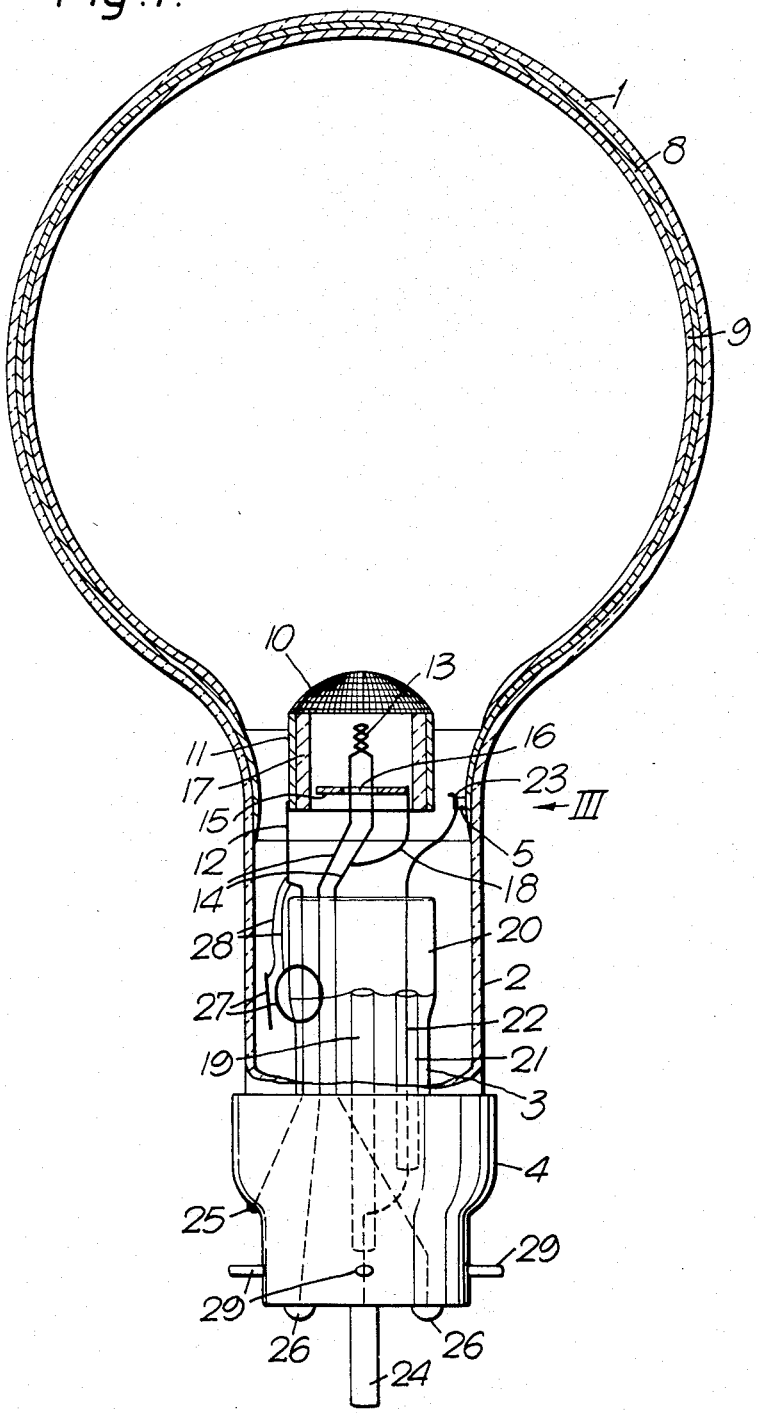

CATHODOLUMINESCENT LIGHT SOURCES AND ELECTRIC LIGHTING ARRANGEMENTS INCLUDING SUCH SOURCES

This invention relates to cathodoluminescent light sources in the form of electric lamps which are suitable for use for general lighting purposes, and to electric lighting arrangements including such lamps.

In the specification of our co-pending U.K. Patent Application No. 8102935 there is described a cathodoluminescent lamp which includes an evacuated bulbous glass envelope with an integral glass neck terminated by a cap, an anode constituted by an electrically conductive coating on the interior surface of the bulb wall, such that at least part of the bulb wall is light-transmissive, a phosphor coating on the whole of the interior of the bulb wall and overlying the anode coating, a dome-shaped grid located within the bulb and supported by a hollow metal cylinder disposed within the envelope neck, and an electron emissive cathode mounted within the assembly of the grid and its supporting cylinder. The current-conducting leads to the cathode and the grid are sealed into the closure of the envelope neck, suitably a pinched glass foot tube, and extend to contacts on the lamp cap, and the lead to the anode is located along the exterior of the neck, being sealed through the envelope wall for connection to the anode coating, and extending to a contact provided on the exterior of the neck.

The specification of our co-pending Patent Application No. 8134718 (now U.K. Published Application No. 2089561) is concerned with an improvement in respect of the location of the lead to the anode, in lamps of the form described in the specification of Application No. 8102935 (now U.K. Published Application No. 2090849), cognate with U.S. Pat. No. 4,352,043, in that the anode lead is located wholly within the envelope neck and neck closure, passes through an exhaust tube incorporated in a pinched glass foot tube which constitutes the neck closure, and extends to a contact carried by the lamp cap. In the specific embodiment described in the specification of Application No. 8134718, the anode lead is mainly laid close to the interior surface of the envelope neck, so as to be spaced as far as possible from the cathode and grid leads, and the portion of the anode lead extending from the vicinity of the neck wall to the exahust tube is covered by a glass sleeve, for insulation; for connection of the anode coating to the anode lead, a coating of carbon is applied to the interior surface of the neck-bulb junction region of the envelope, covering the edge region of the anode coating, and the lead is attached to the carbon coating by means of a silver paint contact applied over the inner end of the lead in contact with the carbon.

It is an object of the present invention to provide, in lamps of the kind to which the above-mentioned specifications relate, further improvements in the location of the anode lead and the connection thereof to the anode coating.

According to the invention, in a cathodoluminescent lamp which includes an evacuated bulbous glass envelope with an integral glass neck closed by a pinched glass foot tube incorporating an exhaust tube located around the longitudinal axis of the foot tube, the foot tube terminating in a cap, an anode constituted by an electrically conductive coating on at least part of the interior surface of the bulb wall, such that at least part of the bulb wall is light-transmissive, a layer of phosphor on the whole of the interior of the bulb wall and overlying the said anode coating, which phosphor is excitable to luminescence by electron bombardment, a dome-shaped grid located within the bulb adjacent to the junction between the bulb and neck of the envelope and supported by a hollow metal cylinder disposed coaxially within the neck, an electron emissive cathode mounted within the assembly of the grid and its supporting cylinder, electrically conducting leads, all located wholly within the envelope neck and foot tube, connecting the anode, grid and cathode to respective external contacts carried by the said cap for connection to a circuit arrangement for operation of the lamp from a source of electric current supply, an additional glass tube provided within the foot tube, extending from the pinch substantially parallel to the exhaust tube and adjacent to the wall of the foot tube, the lead to the anode passing through the said additional tube and being sealed through the pinch, the leads to the cathode and grid passing through the foot tube, and being sealed through the pinch, in locations at the side of the exhaust tube remote from the said additional tube and anode lead, and an internal anode contact is provided on the interior surface of the envelope neck in the form of a metal strip, the end portions of which are secured to the glass of the neck and the central portion of which is bent so as to be upstanding from the neck surface, the said anode coating extending from the bulb over the internal neck surface to a level beyond that of the said metal strip, so as to cover the said end portions of the strip, and the inner end of the anode lead being inserted through, and being so shaped that it engages with, the said upstanding portion of the metal strip.

The end of the anode lead wire may be bent to form a hook to engage with the contact strip, or alternatively a short length of metal strip may be attached to the end of the wire and bent to the required shape; if desired such metal strip may be of sufficient length, and so shaped, to make additional contact with the anode coating on the neck.

The internal anode connection arrangement in accordance with the invention is advantageous in that it facilitates the assembly of the lamp in manufacture. Furthermore, the arrangement of the leads in the pinched foot tube, described above, with the anode lead surrounded by the additional glass tube, provides improved isolation of the anode lead from the grid and cathode leads, which is desirable in view of the fact that a high potential is required to be applied to the anode for operation of the lamp. The portion of the anode lead extending from the pinch to the metal strip contact on the neck should be located at as great a distance as possible from the grid and cathode leads and the grid-supporting cylinder, and may if desired be insulated, at least partially, by a surrounding glass sleeve.

The anode coating preferably covers the whole of the interior surface of the bulb wall, as well as part of the neck wall as aforesaid, and may consist of a known type of light-transmissive electrically conducting coating formed, for example, of tin oxide and/or indium oxide. Alternatively, part of the bulb may be provided with an internal reflective metal coating which also serves as at least part of the anode, the remainder of the bulb either being free from any conductive coating or, preferably, having a light-transmissive conductive coating to provide continuity of the anode over the whole of the bulb wall.

The cathode should be, as specified in the specification of Application No. 8102935, so shaped, and/or so located within the grid assembly, that the electrons emitted from the cathode in operation of the lamp are substantially uniformly distributed over the whole of the surface of the grid on which they impinge. Thus the cathode may be of effectively circular form, consisting either of a directly heated coil filament of "wreath" form incorporating electron emissive material, or of an indirectly heated hollow metal cylinder capped with a metal disc coated externally with electron emissive material, in either case the electron emissive part of the cathode being located in the region of the junction between the grid and the metal cylinder. Alternatively the cathode may consist of a directly heated linear coil filament located within the grid-supporting cylinder and disposed either orthogonally to, or coaxially with, the cylinder axis. Another suitable form of cathode consists of a directly heated body formed of metal mesh or perforated metal foil, preferably a strip bent into a U shape and mounted with the base of the U, which carries electron emissive material, facing towards the grid and located within the grid-supporting cylinder a short distance from the plane of the base of the grid.

The invention further provides an electric lighting arrangement consisting of a lamp of the form described above, and a circuit arrangement for operating the said lamp from a source of electric current supply, which circuit arrangement includes means for converting the supply voltage to unidirectional operating potentials of required magnitudes for application respectively to the anode, cathode and grid of the lamp. Suitable operating potentials are 5 to 15 kilovolts applied to the anode, 40 to 250 volts applied to the grid, and a cathode potential lower than that applied to the grid.

The circuit arrangement may be contained within a housing which is detachably mounted on the lamp cap and is insertable into a lampholder, or may be incorporated in a lampholder, the housing or lampholder being provided with contacts arranged to co-operate with the contacts on the lamp cap.

Figure 2:
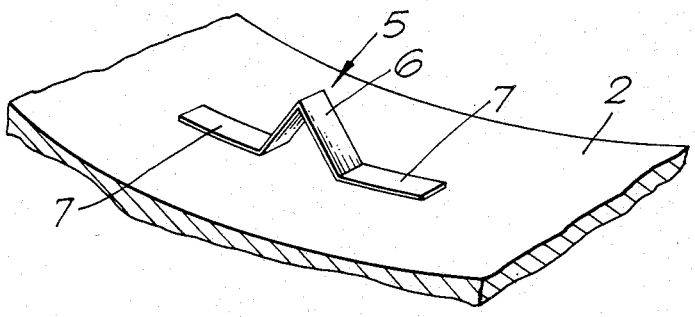
Figure 3:
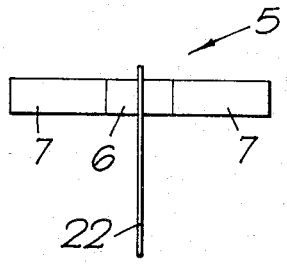

A specific form of lamp in accordance with the invention will now be described by way of example with reference to the accompanying diagrammatic drawings, in which FIG. 1 shows the lamp in part-sectional elevation, FIG. 2 is a perspective view of the metal strip contact attached to the envelope neck, and FIG. 3 shows the connection between the metal strip contact and the anode lead, as observed in the direction of the arrow III in FIG. 1.

The lamp shown in FIG. 1, which is designed for general lighting service, comprises an evacuated envelope formed of any suitable glass which will inhibit the transmission of X-rays generated by the electron bombardment of the envelope in operation of the lamp, and consisting of a spherical bulb 1 and an integral neck 2 in which an electron gun assembly is mounted, supported from a pinched glass foot tube 3 which is sealed into the neck opening in conventional manner; a brass cap 4 is cemented on to the neck, also in conventional manner.

A metal strip 5 is attached to the interior surface of the envelope neck, a short distance below the junction of the neck with the bulb 1. This strip is suitably formed of a nickel-iron alloy containing 48% of weight of nickel, and is shaped as shown in FIG. 2 of the drawings, which is a perspective view of the metal strip and a portion of the neck as observed through the bulb: thus the strip is bent to form a central upstanding portion 6, spaced from the neck surface, the flat end portions 7 being secured to the glass. Typically the metal strip is 1 mm wide and 0.1 mm thick, the end portions 7 are 2 mm long, and the sides of the upstanding portion 6 are each 1.5 mm long.

A transparent film 8 of electrically conducting material such as tin oxide and/or indium oxide, constituting the anode, covers the whole of the interior surface of the bulb 1 and extends over a portion of the neck 2 to a level below that of the metal strip 5, so as to cover the end portions 7 of the strip, and a coating of electron-respective phosphor 9 overlays the conducting film on the bulb: these coatings are shown in exaggerated thickness in FIG. 1.

The electron gun assembly consists of a dome-shaped grid 10 formed of metal wire mesh, supported on a hollow metal cylinder 11, to which a support/lead wire 12 is attached, a cathode 13 in the form of a tungsten wire helix incorporating electron emissive material, disposed coaxially with the cylinder 11 and with its upper end about 2 mm below the plane of the base of the grid, and supported on lead wires 14, and a metal disc 15 with a central aperture 16 to permit passage of the cathode leads therethrough, the disc being located within the cylinder 11 close to the open end thereof, insulated from the cylinder by a glass sleeve 17 fitted inside the cylinder, and supported by a wire 18 which is attached to one of the cathode leads 14 which is the negative lead to the cathode in operation. The function of the disc 15 is to act as a baffle plate for obstructing any electrons emitted by the cathode in operation which, in the absence of the disc, would escape through the open lower end of the cylinder 11 and would be attracted to the interior surface of the envelope neck, which is positively charged in operation, thus heating the neck and possibly causing it to crack.

The wire mesh grid may suitably be formed of nickel or stainless steel. The cylinder 11 and disc 15 are preferably formed of titanium, but may be of other metal such as nickel or stainless steel. The grid lead wire 12, the cathode lead wires 14, and the baffle disc support wire 18 are suitably all of nickel.

The foot tube 3 incorporates a glass exhaust tube 19, extending from the pinch 20 in conventional manner, and an additional glass tube 21 also extending from the pinch, substantially parallel to the exhaust tube. A wire 22, suitably formed of 48% nickel-52% iron alloy or of a conventional three-part joined wire, passes through the tube 21, is sealed through the pinch, and extends to the metal strip 5 on the envelope neck, the end of the wire being formed with a hook 23 which engages with the upstanding portion 6 of the metal strip: this arrangement is shown in elevation in FIG. 3. The metal strip 5 forms a contact to the anode, and the wire 22 thus constitutes the lead to the anode, and is connected to a pin contact 24 carried by the insulating closure of the lamp cap 4.

The grid lead 12 and cathode leads 14 are sealed through the part of the pinch which is on the opposite side of the exhaust tube to that part of the pinch in which the tube 21 and anode lead 22 are located. The grid lead 12 is connected at 25 to the cap 4 which thus constitutes the grid contact on the lamp. The cathode leads 14 are connected to contacts 26 carried by the cap insulation, the location of the cathode leads within the cap being spaced as far as possible from that portion of the anode lead extending from the lower end of the tube 21 to the contact 24, so that the anode and cathode leads are insulated from one another by the insulating material (not shown) inside the cap.

Barium/aluminium getter rings 27, of known form, are supported within the envelope neck by wires 28 attached to the grid lead wire 12. The cap 4 is provided with locating pins 29, preferably three in number, to ensure correct orientation of the lamp in a lampholder or housing for the required connection of the respective contacts 24, 25 and 26 to an operating circuit.

In the manufacture of the lamp described above with reference to the drawings, the metal strip anode contact 5 is first placed in position on the neck surface and is secured to the glass by heating the exterior of the requisite portion of the neck with a flame, sufficiently to soften the glass and cause it to bond to the metal. The conducting film 8 is then applied to the interior surface of the bulb and part of the neck as aforesaid, in known manner, the joints between the conducting film and the contact strip 5 are covered with silver paint, and the phosphor coating 9 is applied over the film 8 on the bulb. The preformed assembly of pinched foot tube 2, tube 21, leads 12, 14, and 22, grid 10, cylinder 11, cathode 13, disc 15, and getter rings 27, is then inserted into the neck so that the anode lead 22 engages with the metal strip 5, and the foot tube is sealed into the neck. The lamp is evacuated, the exhaust tube 19 is sealed, and the neck is capped, the leads being connected to the respective contacts, all in the conventional manner.

We claim:

1. In a cathodoluminescent lamp including an evacuated bulbous glass envelope with an integral glass neck closed by a pinched glass foot tube incorporating an exhaust tube located around the longitudinal axis of the foot tube, the foot tube terminating in a cap, an anode constituted by an electrically conductive coating on at least part of the interior surface of the bulb wall, such that at least part of the bulb wall is light-transmissive, a layer of phosphor on the whole of the interior of the bulb wall and overlying the said anode coating, which phosphor is excitable to luminescence by electron bombardment, a dome-shaped grid location within the bulb adjacent to the junction between the bulb and neck of the envelope and supported by a hollow metal cylinder disposed coaxially within the neck, an electron emissive cathode mounted within the assembly of the grid and its supporting cylinder, electrically conducting leads, all located wholly within the envelope neck and foot tube, connecting the anode, grid and cathode to respective external contacts carried by the said cap for connection to a circuit arrangement for operation of the lamp from a source of electric current supply, the improvement comprising an additional glass tube provided within the foot tube, extending from the pinch substantially parallel to the exhaust tube and adjacent to the wall of the foot tube, the lead to the anode passing through the said additional tube and being sealed through the pinch, the leads to the cathode and grid passing through the foot tube, and being sealed through the pinch in locations at the side of the exhaust tube remote from the said additional tube and anode lead, and an internal anode contact provided on the interior surface of the envelope neck in the form of a metal strip, the end portions of which are secured to the glass of the neck and the central portion of which is bent so as to be upstanding from the neck surface, the said anode coating extending from the bulb over the internal neck surface to a level beyond that of the said metal strip, so as to cover the said end portions of the strip, and the inner end of the anode lead being inserted through, and being so shaped that it engages with the said upstanding portion of the metal strip.

2. A cathodoluminencent lamp according to claim 1 wherein the inner end of the anode lead is bent to form a hook to engage with the contact strip.

3. A cathodoluminescent lamp according to claim 1 wherein the anode coating covers the whole of the interior surface of the bulb wall.

4. A cathodoluminescent lamp accordimg to claim 1 wherein the anode coating consists of a light transmissive electrically conductive coating.

5. A cathodoluminescent lamp according to claim 4 wherein the anode coating is formed of tin oxide and/or indium oxide.

* * * * *